US005808718A

United States Patent [19]

Aikoh et al.

[11] Patent Number: 5,808,718

[45] Date of Patent: Sep. 15, 1998

[54] LED PRINT HEAD AND METHOD OF ADJUSTING THE FOCUS THEREOF

[75] Inventors: Yoshihisa Aikoh; Minoru Teshima; Norio Nakajima; Hisashi Tsukagoshi, all of Tokyo, Japan

[73] Assignee: Oki Data Corporation, Tokyo, Japan

[21] Appl. No.: 665,223

[22] Filed: Jun. 18, 1996

[30] Foreign Application Priority Data

Jun. 22, 1995 [JP] Japan ..... 7-155935

[51] Int. Cl.[6] ..... G03G 13/04; B41J 2/385

[52] U.S. Cl. ..... 347/130; 347/238; 347/242

[58] Field of Search ..... 347/238, 242, 347/245, 130

[56] References Cited

U.S. PATENT DOCUMENTS

| | | | |
|---|---|---|---|
| 5,173,759 | 12/1992 | Murano | 257/88 |
| 5,390,670 | 2/1995 | Centa et al. | 128/663 |
| 5,495,281 | 2/1996 | Nashida et al. | 347/263 |
| 5,504,514 | 4/1996 | Nelson | 347/130 |
| 5,506,612 | 4/1996 | Ogata et al. | 347/138 |
| 5,515,097 | 5/1996 | Munechika et al. | 347/241 |
| 5,585,783 | 12/1996 | Hall | 340/473 |

*Primary Examiner*—Safet Metjahic
*Attorney, Agent, or Firm*—Rabin & Champagne, P.C.

[57] ABSTRACT

An LED print head is for use in an LED printer. The LED print head has an LED circuit board on which a plurality of LED chips are mounted in line, and a lens assembly having rod lenses for focusing light emitted from the LED chips on a surface of a photosensitive drum in the LED printer. A first member or slider engages either the LED circuit board or the lens assembly and is adapted to displace stepwise to cause either the LED circuit board or the lens assembly to flex stepwise relative to the surface of the photosensitive drum. A second member or slider engages said first member to movably hold said first member. The LED circuit board or lens assembly is flexed so that a point on the photosensitive drum and the surface of the corresponding LED form a pair of conjugate points with respect to the corresponding rod lens.

10 Claims, 14 Drawing Sheets

LED PRINT HEAD AND METHOD OF ADJUSTING THE FOCUS THEREOF

BACKGROUND OF THE INVENTION

The present invention relates to an LED print head which facilitates optimum focus adjustment and a method of adjusting the focus of the LED print head.

FIGS. 14–16 illustrate a prior art LED printer, FIG. 14 showing a side view of a general construction of the LED printer, FIG. 15 showing a cross-sectional view taken along the lines C—C in FIG. 14, and FIG. 16 showing a fragmentary view of the part depicted in an area indicated by D in FIG. 14. Referring to FIGS. 14–16, the prior art LED printer includes an LED print head 51, photosensitive drum 52, and adjustment mechanism 53 for adjusting the distance between the LED print head 51 and the photosensitive drum 52.

FIG. 15 shows the interior of the LED print head 51. The LED print head 51 includes a lens holder 55 which holds a lens assembly 54 in place, LED circuit board 56, and chassis 57.

FIG. 17 shows a part of the lens assembly 54. A plurality of rod lenses 58 are closely aligned in adjacent two rows. The two rows are held between side plates 59 in sandwiched relation with upper and lower lens surfaces 54*a* and 54*b* of the lenses 58 exposed. The side plates 59 are made of FRP (Fiber Reinforced Plastics). The gaps between the rod lenses 58 in the lens assembly 54 are filled with black silicone resin 60 so that the lens assembly 54 is of integral construction. The lens assembly 54 is fixed to a lens holder 55 with the lens surfaces 54*a* and 54*b* facing up and down, respectively. The lens holder 55 is provided with a lens stopper 55*a* which abuts the upper end of the lens assembly 54 upon completion of assembly, thereby holding the lens assembly 54 in position. The stopper 55*a* prevents the lens assembly 54 from flexing to extend to the LED circuit board 56.

The LED circuit board 56 is in the form of, for example, a glass epoxy board. FIG. 18 shows a top view of the LED circuit board 56 and FIG. 19 shows a side view thereof. The LED circuit board 56 holds a plurality of LED driver chips 62 thereon aligned in two parallel rows extending longitudinally of the LED circuit board 56, and a plurality of LED chips 61 also aligned in a row extending between the two rows of the LED driver chips 62. For example, a 600 DPI (Dot Per Inch)/A4 size width LED print head 51 requires thirty nine LED chips 61, each chip producing 128 dots.

Referring again to FIG. 14, the photosensitive drum 52 is supported by a drum holder 63 to which the LED print head 51 is mounted by means of the adjustment mechanism 53.

The adjustment mechanisms 53 are oppositely provided at longitudinal ends of the LED print head 51. FIG. 16 shows the detail of the adjustment mechanism 53. The adjustment mechanism 53 includes a wedge 53*a* slidably mounted on the top surface of the drum holder 63, and a flat spring 53*b* projecting from the wedge 53*a*. The wedge 53*a* has a beveled surface 53*d* which is slidably in contact with the beveled surface 64 of a projection 55*b* projecting from the lens holder 55. When the wedge 53*a* is moved in the direction shown by arrow 66, the LED print head 51 is moved in the direction shown by arrow 67. The projection 55*b* of the lens holder 55 is formed with a rack 68 therein which is pressure-engaged with a V-shaped tip 53*c* of the flat spring 53*b*. This pressure-engagement holds the wedge 53*a* against movement in the direction shown by arrow 66, but allows, by resilient deformation of the flat spring 53*b*, the wedge 53*a* to move in steps in the direction shown by arrow 66.

When the LED chips 61 on the LED circuit board 56 are energized to emit light, the LEDs illuminate the photosensitive surface of the photosensitive drum 52 through the lenses 58. The illuminated light spot forms a dot of an electrostatic latent image on the photosensitive drum 52. The light spots illuminated through the lenses 58 must form images of the same intensity at any location on the photosensitive drum 52. However, the focus condition of the spot images varies, from area to area on the photosensitive drum. This is due to manufacturing variations in the dimensions and characteristics of the parts. Thus, so-called focus alignment is necessary during the manufacture of the LED print heads in order to accommodate the variations in focus. Conventionally, focus alignment is effected by moving the wedge 53*a* back and forth in the direction shown by arrow 66 in FIG. 16 so that the entire LED print head 51 moves by a distance $\Delta y$ in the direction shown by arrow 67 in FIG. 16 till spot images are clearly formed on the photosensitive drum 52.

The conventional method of adjusting focus is sufficiently effective if the photosensitive drum is of the same diameter along its full length of axis of rotation. However, the method is not effective if the photosensitive drum has a diameter varying along its axis of rotation.

SUMMARY OF THE INVENTION

An object of the invention is to provide an LED print head in which optimum focus alignment is achieved accurately without difficulty even if the photosensitive drum has a diameter varying along its axis of rotation.

Another object of the invention is to provide a method of focusing of the aforementioned LED print head for use with a photosensitive drum having a diameter varying along its axis of rotation.

The LED print head has an LED circuit board on which a plurality of LED chips are mounted in line, and a lens assembly having rod lenses for focusing light emitted from the LED chips on the surface of the photosensitive drum in the LED printer. A first member or slider engages either the LED circuit board or the lens assembly and is adapted to displace stepwise to cause either the LED circuit board or the lens assembly to flex stepwise relative to the surface of the photosensitive drum. A second member or slider engages the first member to movably hold the first member. The LED circuit board or lens assembly is flexed so that a point on the photosensitive drum and the surface of the corresponding LED form a pair of conjugate points with respect to the corresponding rod lens.

DETAILED DESCRIPTION OF THE INVENTION

Preferred embodiments of the invention will now be described in detail with reference to the drawings. The embodiments are described with respect to a barrel-shaped photosensitive drum having a diameter varying along its axis of rotation. A conventional cylindrical photosensitive drum receives less force at its middle portion than at the other areas due to deformation of the drum, causing variations in the density of print. This deformation of the drum is due to the fact that the drum is urged by a feeding roller in contact with the drum. In contrast, a barrel-shaped drum receives a uniform force along its axis of rotation, resulting in uniform density of the print. However, exactly focusing an image in one area of the barrel-shaped drum surface may result in poor focusing in the other area, due to its diameter continuously varying along the axis of rotation. Thus, the barrel-shaped drum requires focus adjustment in accordance with its diameter varying along the entire axis of rotation of the drum.

First embodiment

Figure 1:
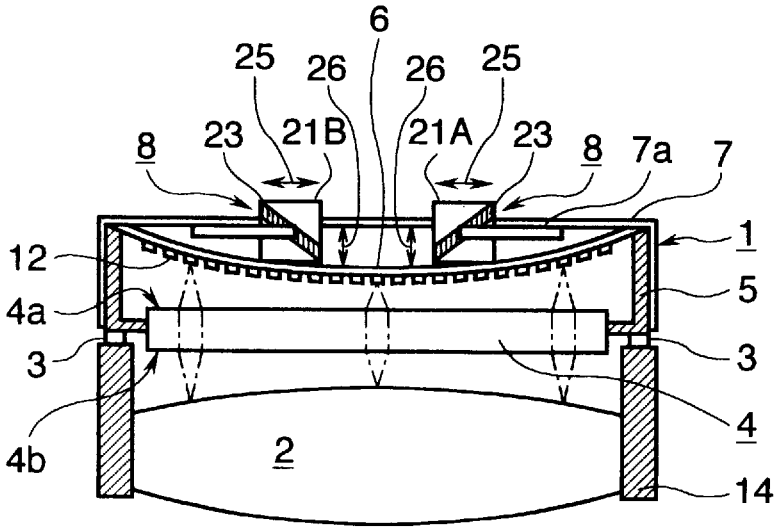
FIG. 1 shows a schematic, longitudinal cross sectional view of an LED print head according to a first embodiment.
Figure 2:
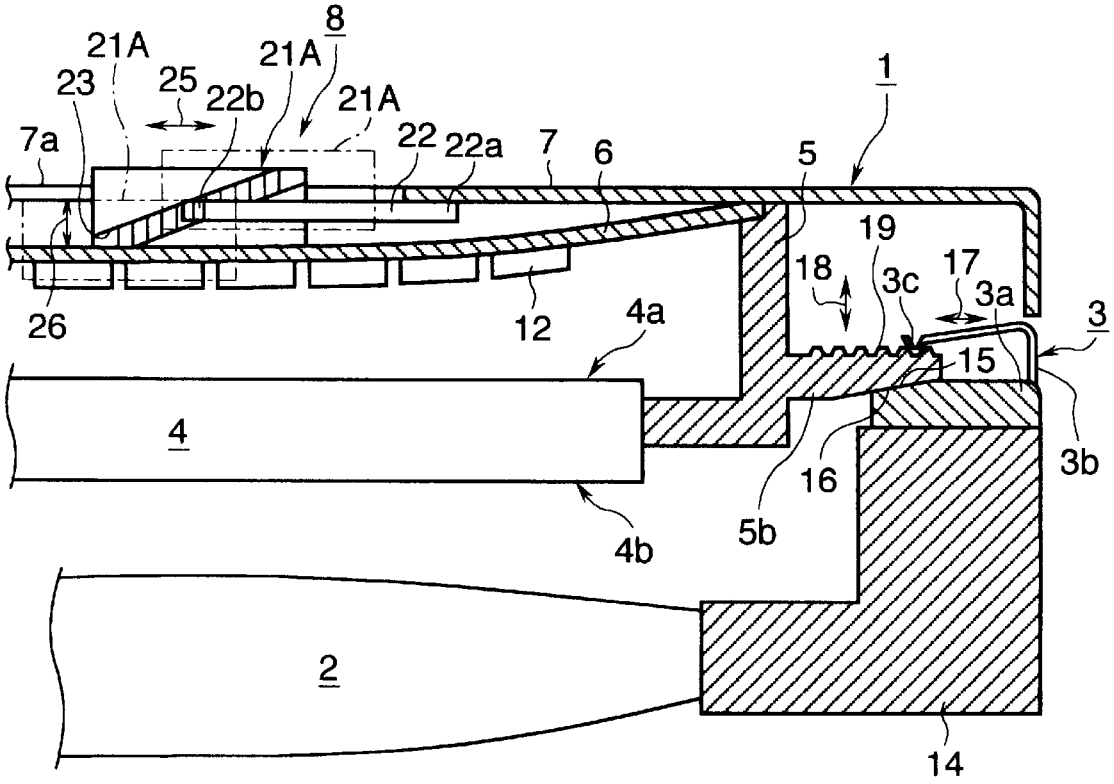
FIG. 2 shows an enlarged cross section of an essential part of the first embodiment.
Figure 3:
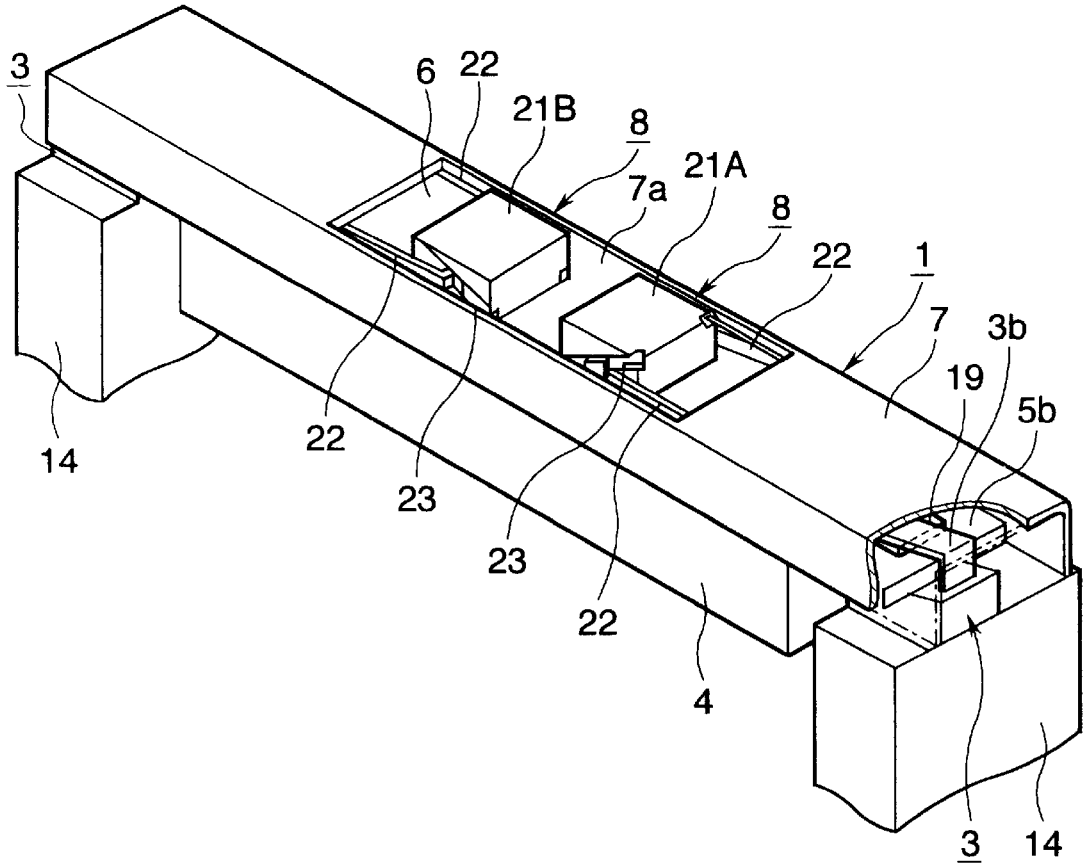
FIG. 3 shows a perspective view of the essential part of the first embodiment.

FIGS. 1–3 illustrate an LED print head to which the present invention is applied, FIG. 1 showing a schematic, longitudinal cross-sectional view, FIG. 2 showing an enlarged cross sectional view of a pertinent part of the LED print head, and FIG. 3 showing a perspective view of the pertinent part.

Referring to FIGS. 1–3, an LED printer includes an LED print head 1, a barrel-shaped photosensitive drum 2, and an adjustment mechanism 3 for adjusting the distance between the LED print head 1 and the photosensitive drum 2.

In more detail, as shown in FIGS. 1 and 2, the LED print head 1 includes an LED circuit board 6, chassis 7, lens holder 5 that holds a lens assembly 4 in place, and adjustment mechanism 8 that causes the LED circuit board 6 to be resiliently deformed.

Figure 6:
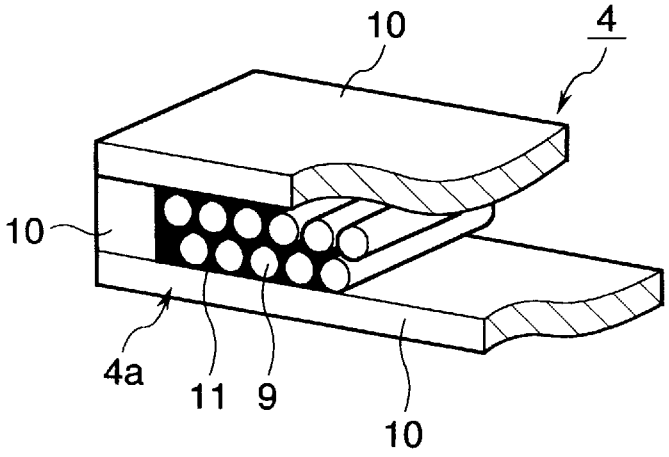
FIG. 6 illustrates the lens assembly having a plurality of rod lenses aligned in two parallel rows.

Referring to FIG. 6, the lens assembly 4 has a plurality of rod lenses 9 aligned in two parallel rows. The two rows of rod lens 9 are held by side plates 10 in sandwiched relation, with upper and lower lens surfaces 4*a* and 4*b* of the rod lens 9 exposed. The side plates 10 are formed of FRP (Fiber Reinforced Plastics). The gaps between the rod lenses 9 of the lens assembly 4 are filled with black silicone resin 11 so that the lens assembly 4 is of integral construction. The lens assembly 4 is fixed to a lens holder 5 with lens surfaces 4*a* and 4*b* facing up and down, respectively.

Figure 4:
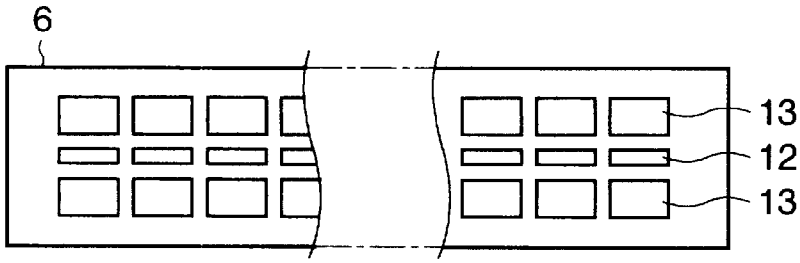
FIG. 4 shows a top view of the LED circuit board.
Figure 5:
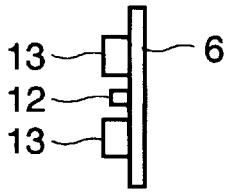
FIG. 5 shows a side view of the LED circuit board in FIG. 4.

The LED circuit board 6 is in the form of a resiliently deformable plate such as a glass epoxy circuit board. FIG. 4 shows a top view of the LED circuit board 6 and FIG. 5 shows a side view thereof. The LED circuit board 6 holds a plurality of LED driver chips 13 thereon aligned in two parallel rows extending longitudinally of the board 6, and a plurality of LED chips 12 also aligned in a row extending between the two rows of the LED driver chips 13. For example, a 600 DPI (Dot Per Inch)/A4-size width LED print head 1 requires thirty nine LED chips 12, each chip producing 128 dots.

The photosensitive drum 2 is supported by drum holders 14 to which the LED print head 1 is mounted by means of two adjustment mechanisms 3.

Figure 7:
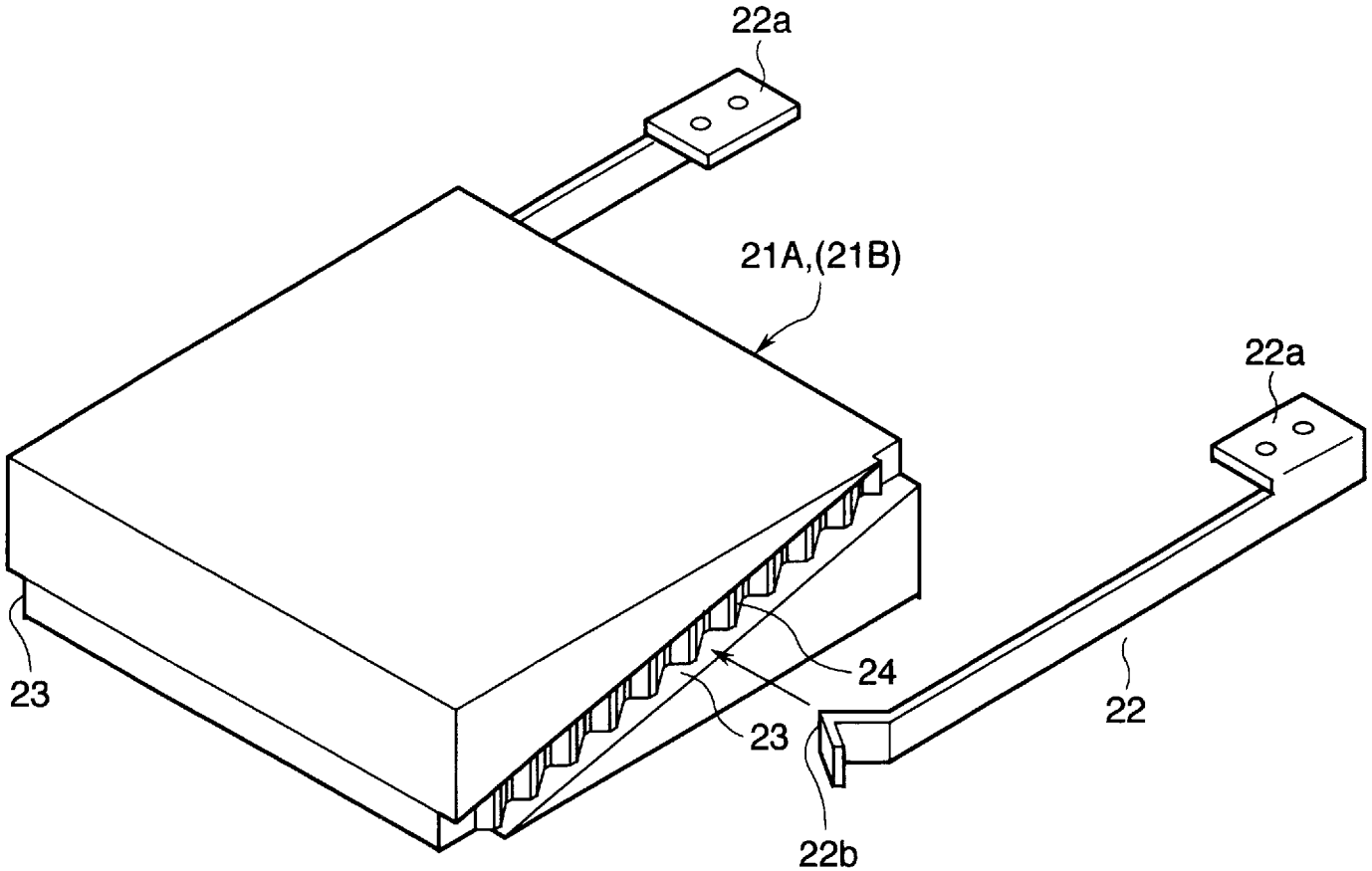
FIG. 7 illustrates the detail of the adjustment mechanism.

The adjustment mechanisms 3 are oppositely provided at longitudinal ends of the LED print head 1. FIG. 2 shows the detail of the adjustment mechanism 3. The adjustment mechanism 3 includes a wedge 3*a* slidably mounted on the top surface of the drum holder 14, and a flat spring 3*b* projecting from the wedge 3*a*. The wedge 3*a* has a beveled surface 15 which slidably engages a beveled surface 16 of a projection 5*b* projecting from the lens holder 5. When the wedge 3*a* is moved in the direction shown by arrow 17, i.e., the longitudinal direction of the lens assembly 4, the wedge 3*a* moves the LED print head 1 in the direction shown by arrow 18, i.e., in the direction of the spacing between the LED print lead 1 and the photosensitive drum 2. The projection 5*b* of the lens holder 5 has a rack 19 formed therein which is pressure-engaged with a V-shaped tip 3*c* of the flat spring 3*b* (FIG. 7). This pressure-engagement holds the wedge 3*a* against movement in the direction shown by arrow 17, but allows, by resilient deformation of the flat spring 3*b*, the wedge 3*a* to move in steps in the direction shown by arrow 17.

In addition, the adjustment mechanism 8 includes two sliders 21A and 21B, each of which is supported by a pair of supporting arms 22. As shown in FIG. 7, the supporting arm 22 has one end 22*a* fixed to the inside surface of the chassis 7 and the other end formed into a free end having a V-shaped tip 22*b*. Each pair of supporting arms 22 includes two parallel supporting arms 22 extending in parallel with each other. The sliders 21A and 21B are oppositely mounted separately from each other in the middle in the longitudinal direction of the LED print head 1. Each slider is sandwiched between the two V-shaped tips 22*b* and held in position.

The slider 21A(21B) has two opposing guide grooves 23 formed therein which are inclined such that their height is increased toward the respective longitudinal ends of the LED print head 1. The guide groove 23 has a rack 24 formed in the bottom thereof as shown in FIG. 7. The rack 24 is engaged with the V-shaped tips 22*b* of the arms 22. The chassis 7 is formed with an opening 7*a* therein through which the sliders 21A, 21B upwardly gradually project as they are moved away from the middle in the longitudinal direction of the LED print head 1.

The bottoms of the slider 21A and 21B engage the back side of the LED circuit board 6 to urge the LED circuit board 6 so that the LED circuit board 6 is resiliently deformed downwardly toward the photosensitive drum 2. As the sliders 21A and 21B are moved in the directions shown by arrows 25, the sliders 21A and 21B are displaced vertically in the direction shown by arrow 26 due to inclined grooves 23, causing the LED circuit board to resiliently flex.

When the slider 21A is moved rightwardly in FIGS. 2 and 1, the arms 22 engaging the rack 24 in the groove 23 causes the slider 21A to displace upwardly, causing the LED circuit board 6 to flex less. When the slider 21A is moved leftwardly in FIG. 1, the slider 21A is caused to displace downwardly, causing the LED circuit board 6 to flex more. When the slider 21B is moved leftwardly, the arms 22 engaging the rack 24 causes the slider 21B to displace upwardly, causing the LED circuit board 6 to flex less. When the slider 21B is moved rightwardly, the slider 21B is caused to displace downwardly, causing the LED circuit board 6 to flex more. Thus, selectively positioning the sliders 21A and 21B allows flexing of the LED circuit board 6 to a desired level, thereby adjusting the distances between the lens surfaces 4*a* and the LED chips 12 in a direction parallel with the axis of rotation of the drum.

Figure 8A:
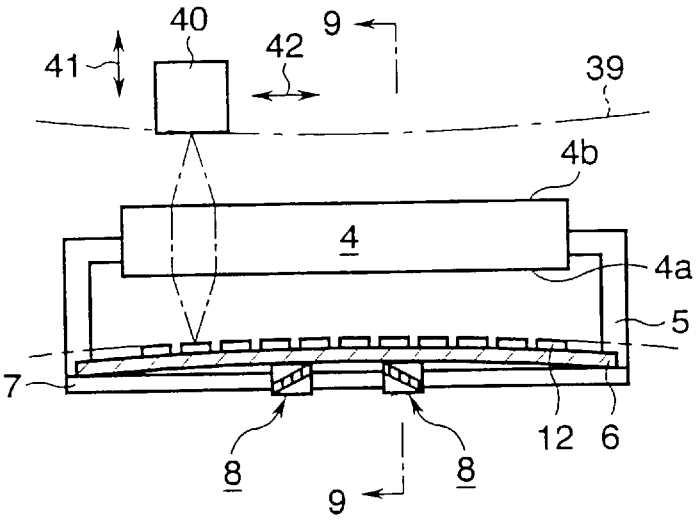
FIG. 8A illustrates the sensor held over the LED print head at a certain height.
Figure 8B:
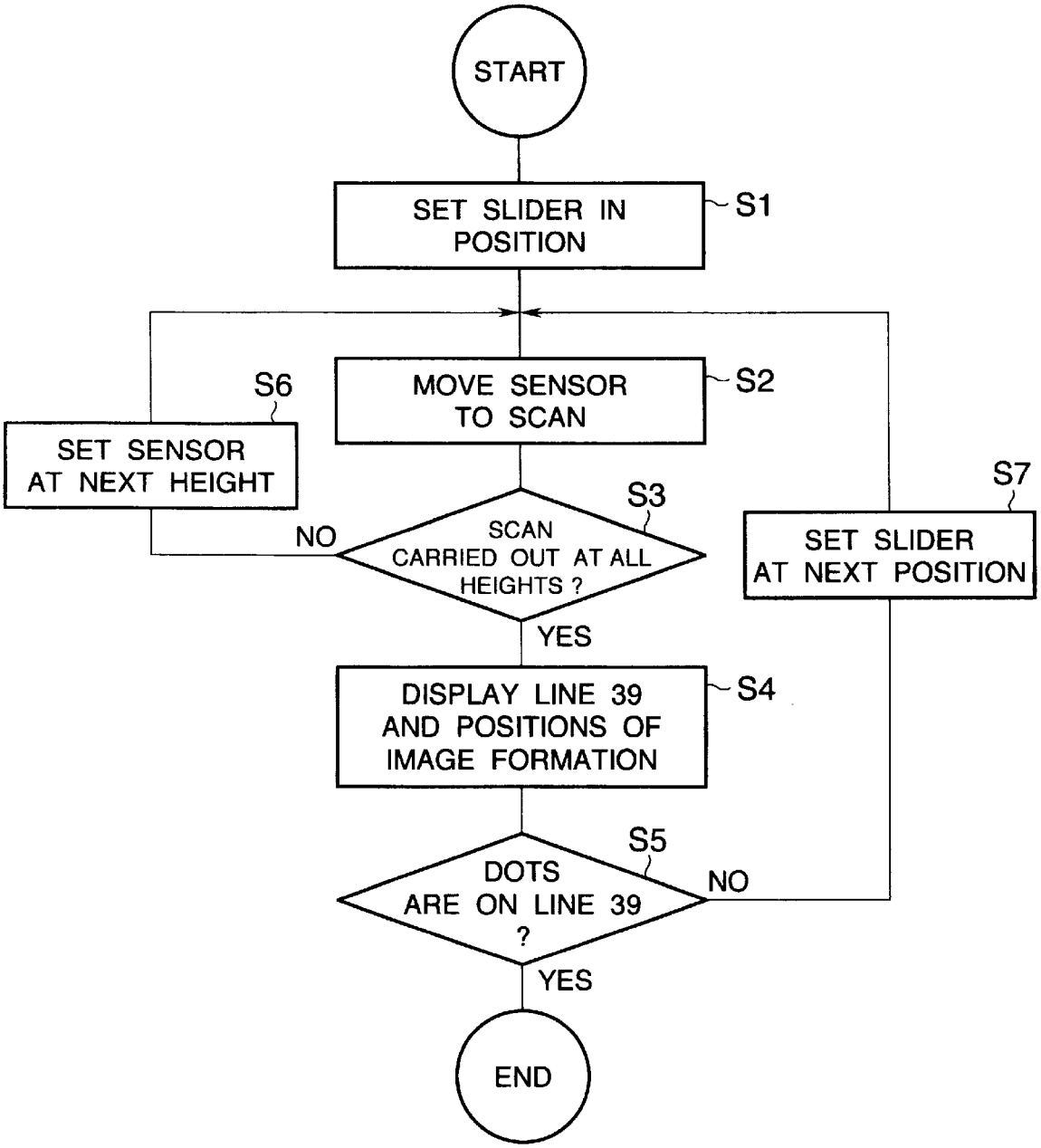
FIG. 8B is a flowchart showing the test and alignment of the condition of focusing of the LEDs.
Figure 8C:
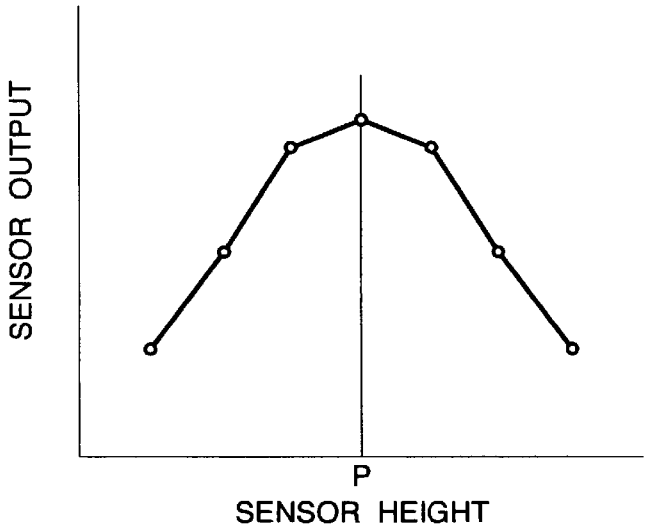
FIG. 8C illustrates the relation between sensor height and sensor output during the test and alignment of the condition of focusing of the LEDs.
Figure 8D:
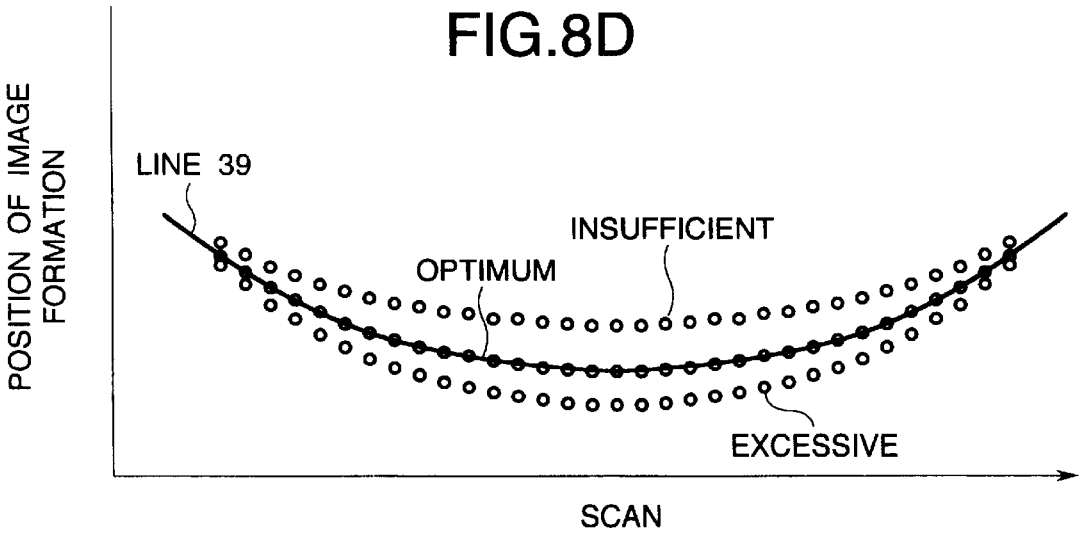
FIG. 8D illustrates the positions of image formation on the display during the test and alignment of the condition of focusing of the LEDs.
Figure 8E:
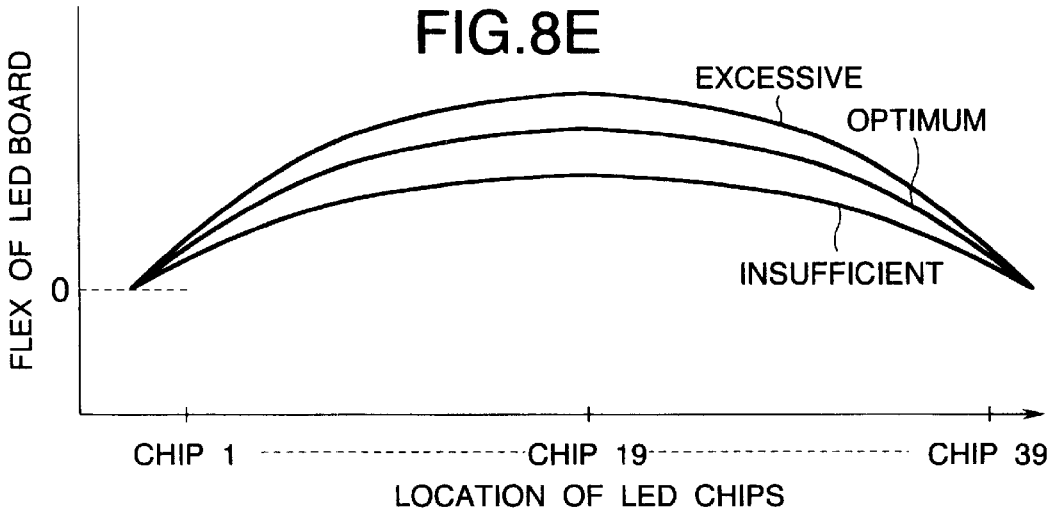
FIG. 8E illustrates the condition of flexing of the LED circuit board during the test and alignment of the condition of focusing of the LEDs.
Figure 9:
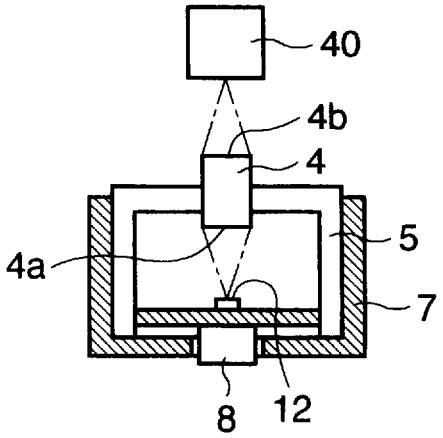
FIG. 9 illustrates a cross-sectional view taken along the lines A—A of FIG. 8.

When the LED chips 12 on the LED circuit board 6 are energized to emit light, the LED chips illuminate the photosensitive surface of the photosensitive drum 2 through the lens assembly 4, forming electrostatic latent images in the form of dots. With the aforementioned LED print head 1, an alignment or focus adjustment is performed after the LED head has been assembled to ensure that the images of the LEDs are formed at the right positions. The focus adjustment in the first embodiment will be described with reference to FIGS. 8A–8E and FIG. 9. FIG. 9 is a cross-sectional side view of FIG. 8A.

First, the LED print head 1 is placed in the reference position and the sensor 40 is held a predetermined distance over the lens assembly 4. The sliders 21A and 21B are moved fully away from the middle in the longitudinal direction so that the LED circuit board 6 is flexed by a least amount at step S1. FIG. 8E illustrates three different levels of flexing of the LED circuit board, i.e., insufficient flexing, optimum flexing, and excessive flexing. Then, at step S2, the sensor 40 is moved over the LED head 1 horizontally to scan in the direction shown by arrow 42 as shown in FIG. 8A. The line 39 simulates the surface of a barrel-shaped photosensitive drum 2, and a point on the line 39 and the surface of the corresponding LED form a pair of conjugate points with respect to the corresponding rod lens. All the LEDs are energized at the same time to emit light. Alternatively, the LEDs may be energized one at a time, in which case the sensor 40 is moved horizontally in timed relation to the energizing of the LEDs.

During the scan, the sensor 40 receives the light and sends its outputs to a controller, not shown. The scan is carried out for each of a predetermined number of heights of the sensor 40. At step S3, a check is made to determine whether the scan has been carried out for all of a predetermined number of heights. If the answer is YES at step S3, then the program proceeds to step S4. If the answer is NO at step S3, the program proceeds to step S6 where the sensor is set to the next height. As shown in FIG. 8C, the sensor output or intensity of the dot-image increases with increasing sensor height, reaching a maximum value when the height reaches an image formation position P, then decreasing with further increasing sensor height. In the embodiment under consideration, the sensor output is determined by averaging the intensities of dots of the LEDs in each LED chip. The controller determines a sensor height at which the sensor output becomes maximum. The maximum sensor output or maximum intensity corresponds to a position at which the image formation of LEDs takes place, the images being the same size as the LEDs. At step S4, the controller displays the positions where the average value for each LED chip is maximum, as shown in FIG. 8D. The position at which the average value of intensity of the dots of each LED chip becomes maximum is a position at which the images of the LEDs are formed. At step S5, a check is made to determine whether the positions where the images of the LEDs are formed substantially lie on the line 39. If the answer is YES at step S5, then the alignment of the LED head 1 completes. If the answer is NO at step S5, then the program proceeds to step S7 where the sliders 21A and 21B are positioned to one step closer to each other for causing the LED circuit board 6 to further flex, and then steps S2 to S5 are repeated. The positions of the sliders 21A and 21B may be selectively set independently of each other for finer alignment of the flexing of the LED circuit board 6. FIG. 8D illustrates three different curves indicating positions of image formation together with the line 39, the curves corresponding to the three levels of flexing of the LED circuit board 6 shown in FIG. 8E. The curves in FIGS. 8D and 8E are exaggerated to clearly show the degree of flexing of the LED circuit board 6 and the corresponding positions of image formation. Theoretically, when the positions at which image formation takes place substantially lie on the line 39, the surface (i.e., line 39) of the photosensitive drum 2 and the LED circuit board 6 are accurately symmetric with respect to the lens assembly 4. Less flexed LED circuit board 6 results in a less curved plot of the positions of image formation while the more flexed LED circuit board 6 results in a more curved plot.

After the LED print head 1 has been adjusted for optimum condition of flexing of the LED circuit board 6, the LED print head 1 is assembled to the drum holder 14. Upon assembling the LED print head 1 in an LED printer, the distance between the LED print head 1 and the surface of the photosensitive drum 2 may slightly differ from the distance between the line 39 and the LED print head 1 due to manufacturing variations in the dimensions of parts of the printer and the surface of the barrels-shaped photosensitive drum 2. Therefore, the distance between the LED print head 1 and the surface of the photosensitive drum 2 may be adjusted by means of the adjustment mechanism 3 for final, fine adjustment. Should the fine adjustment of flexing of the LED circuit board 6 be required after assembling the LED head 1 to the printer, the adjustment mechanism 3 may be adjusted slightly. Steps S2–S5 in FIG. 8B can also be performed to test whether the flexing of the LED circuit board 6 has been adjusted properly adjusted.

The LED print head 1 of the embodiment enables adjustment of the overall distance between the print head 1 and the photosensitive drum 2 and the distance between the lens assembly 4 and the LED chips 12 on the LED circuit board 6 in accordance with the surface of the photosensitive drum 2 having a diameter varying along the axis of rotation of the drum 2, facilitating finer, more accurate adjustment of the focusing of the images of the LED chips 12 formed on the photosensitive drum 2. The embodiment thus lends itself to fine, accurate focus alignment of the LED circuit board 6 even if a photosensitive drum 2 has a varying diameter along its axis of rotation.

Second embodiment

Figure 10:
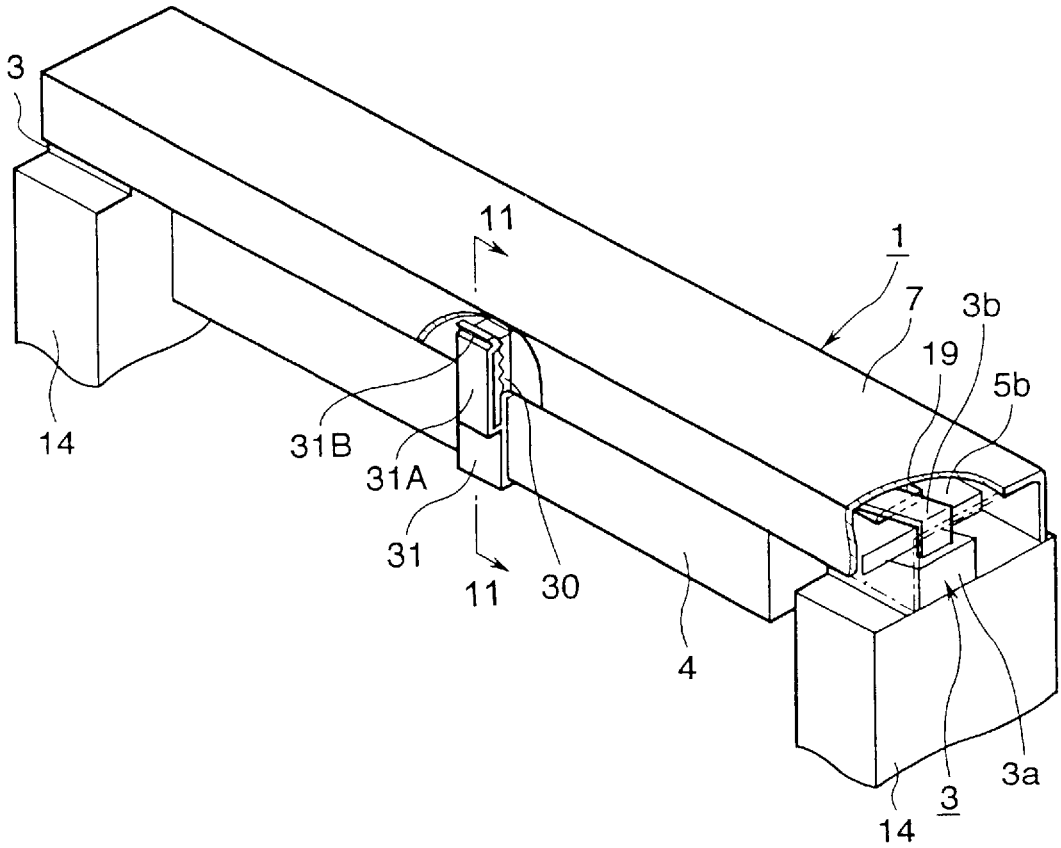
FIG. 10 illustrates a perspective view of an essential part, with a partially cut away view, of an LED printer according to a second embodiment.
Figure 11:
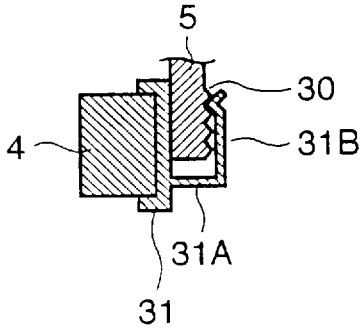
FIG. 11 illustrates a cross-sectional view taken along lines B—B of FIG. 10.
Figure 12:
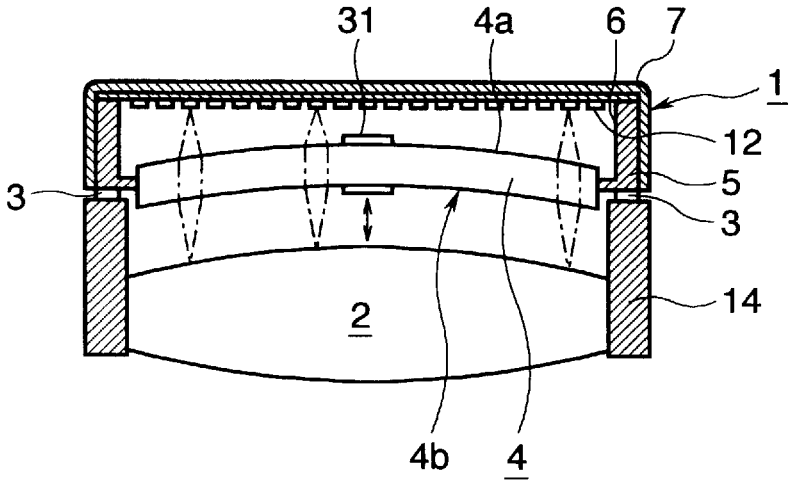
FIG. 12 illustrates a longitudinal cross-sectional view of FIG. 10.

FIGS. 10–12 illustrate an LED print head 1 according to a second embodiment of the invention. FIG. 10 shows a perspective, partially cutaway view of a pertinent part. FIG. 11 shows a cross-sectional view taken along lines B—B of FIG. 10. FIG. 12 shows a longitudinal cross-sectional view of FIG. 10. Elements in FIGS. 10–12 similar to those in FIGS. 1–8A and 9 have been given the same numerals.

In the first embodiment, focus alignment is carried out by causing the sliders 21A and 21B to resiliently flex the LED circuit board 6. The second embodiment differs from the first embodiment in that focus alignment is effected by causing the lens assembly 4 to resiliently flex. In more detail, a lens holder 5 has a rack 30 formed on its side surface in the middle in the longitudinal direction of the lens holder 5. A lens assembly 4 has a slider 31 mounted in the middle of the length thereof. The slider 31 has a flat spring 31A having a V-shaped tip 31B formed on a free end of the flat spring 31A. The V-shaped tip 31B engages the rack 30.

Operating the slider 31 to bring it into engagement with other tooth of the rack 30, causes the lens assembly 4 to resiliently flex differently, so that the condition of flexing of the lens assembly 4 can be adjusted to an optimum condition.

Figure 13:
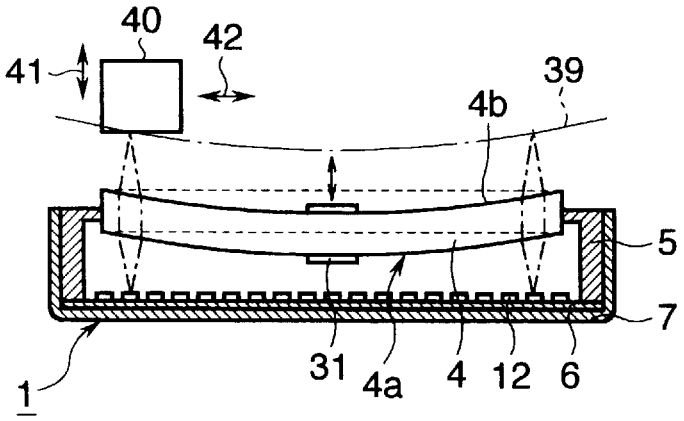
FIG. 13 illustrates how focus test is carried out in the second embodiment.
Figure 14:
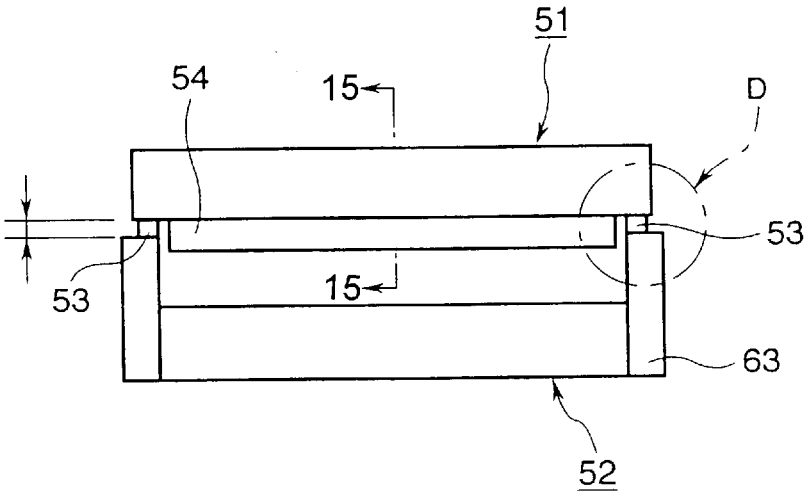
FIG.14 PRIOR ART
FIG. 14 illustrates a side view of a general construction of a prior art LED printer.
Figure 15:
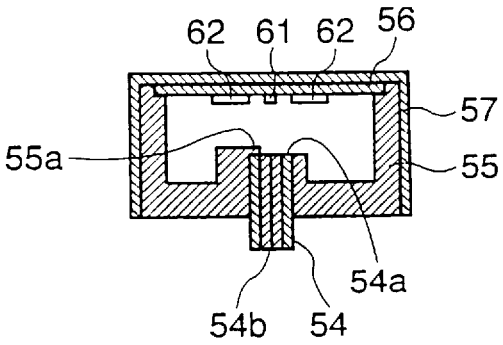
FIG.15 PRIOR ART
FIG. 15 illustrates a cross-sectional view taken along the lines C—C in FIG. 14.
Figure 16:
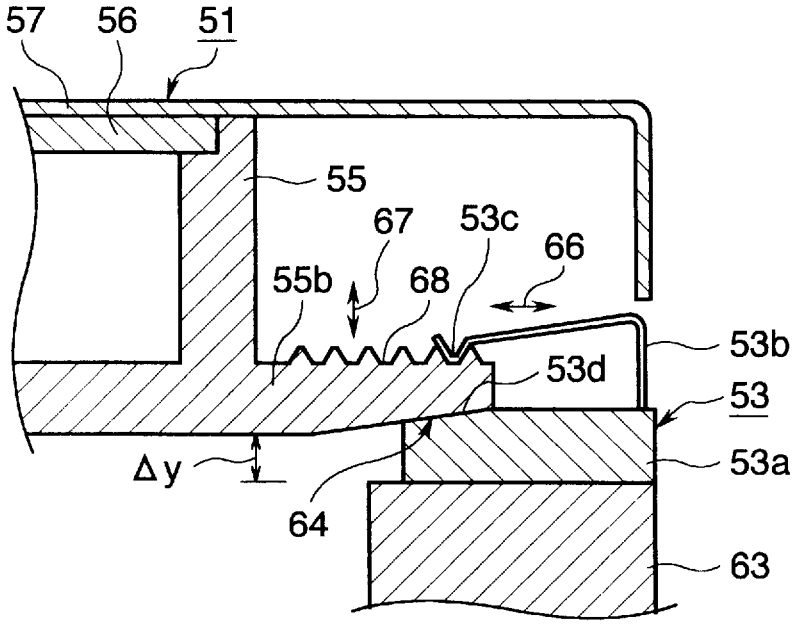
FIG.16 PRIOR ART
FIG. 16 illustrates a fragmentary view of a part D in FIG. 14.
Figure 17:
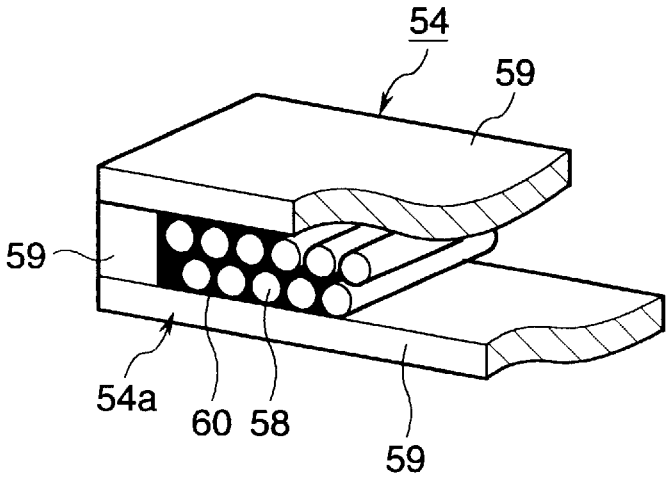
FIG.17 PRIOR ART
FIG. 17 shows an essential part of the lens assembly of the prior art LED print head.
Figure 18:
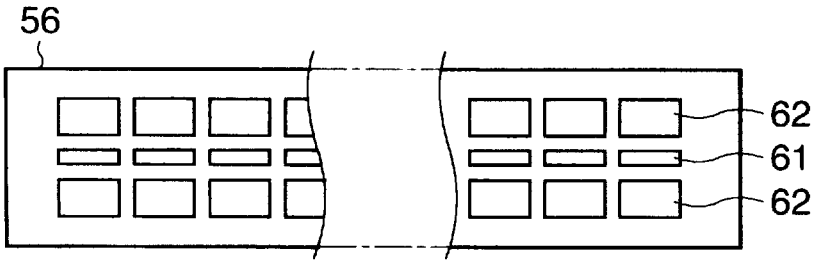
FIG.18 PRIOR ART
FIG. 18 shows a top view of the LED circuit board of the prior art LED print head.
Figure 19:
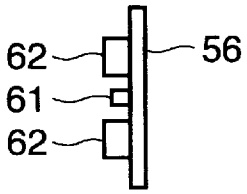
FIG.19 PRIOR ART
FIG. 19 shows a side view thereof.

FIG. 13 illustrates how focus test is carried out in the second embodiment to determine whether the focus of the LED head 1 has been accurately adjusted, and how focus alignment is performed.

The test and focus adjustment in the second embodiment is similar to that of the first embodiment except that instead of the sliders 21A and 21B, the slider 31 is moved to vary the flexing of the lens assembly 4.

After the adjustment, the LED print head 1 is assembled to the drum holder 14 together with the adjustment mechanism 3. After the LED print head 1 has been assembled to the photosensitive drum 2, the adjustment mechanism 3 is operated to adjust the overall distance between the lens surface 4*b* and the photosensitive drum 2 for an optimum focusing. Steps S2–S5 in FIG. 8B can also be performed to test whether the flexing of the lens assembly 4 has been adjusted properly adjusted.

The LED print head of the second embodiment enables to adjust the overall distance between the print head 1 and the photosensitive drum 2 and the distance between the lens assembly 4 and the LED chips 12 on the circuit board 6 in accordance with the surface of a photosensitive drum 2 having a diameter varying along the axis of rotation of the drum, facilitating finer, more accurate adjustment of the focusing of the image of the LED chips 12 formed on the photosensitive drum 2. The embodiment lends itself to fine, accurate focus alignment of the image formed on a photosensitive drum 2 such as a barrel-shaped drum having a diameter varying along the axis of rotation.

If the width of the rack 30 is relatively large compared to the width of the slider 31 so that the slider 31 can slide in the longitudinal direction, then the horizontal position of the slider 31 can be adjusted to some extent in the direction parallel with the length of the LED print head 1. This allows the slider 31 to be placed at any position within the width of the rack 30, effecting finer adjustment of the flexing of the lens assembly 4.

What is claimed is:

1. An LED print head for use in an LED printer, comprising:

an LED circuit board on which a plurality of LED chips are mounted in line, each LED chip having a plurality of LEDs;

a lens assembly for focusing light emitted from the plurality of LEDs at a line of points on a surface of a photosensitive drum, the drum having a diameter that varies along an axis of rotation thereof; wherein at least one of said LED circuit board and said lens assembly is resiliently deformable; and a mechanism adapted to cause said at least one of said LED circuit board and said lens assembly to deform relative to the surface of the photosensitive drum, such that each of the points on the surface of the photosensitive drum are about a same distance from said lens assembly as the respective point's corresponding LED, whereby image formation of each of the LEDs takes place on the surface of the photosensitive drum, with the formed image being essentially the same size as the respective LED.

2. The LED print head according to claim 1, further including:

a mechanism for adjusting a distance between the LED print head and the photosensitive drum.

3. The LED print head according to claim 2, wherein said mechanism for adjusting a distance includes:

a rack movable together with said lens assembly, and having a first inclined surface;

a wedge having a second inclined surface, said wedge being adapted to slide relative to said rack with the second inclined surface in slidable contact with the first inclined surface; and a V-shaped tip provided on said wedge and engaging the rack stepwise to hold said wedge in position when said wedge slides.

4. An LED print head for use in an LED printer, comprising:

an LED circuit board on which a plurality of LED chips are mounted in line, each LED chip having a plurality of LEDs aligned in a row substantially parallel to an axis of rotation of a photosensitive drum, the drum having a diameter that varies along its axis of rotation;

a lens assembly for focusing light emitted from the plurality of LEDs at a line of points on a surface of the photosensitive drum; and a mechanism adapted to cause said LED circuit board to deform relative to the surface of the photosensitive drum such that each of the points on the surface of the photosensitive drum are about a same distance from said lens assemble as the respective point's corresponding LED, whereby image formation of each of the LEDs takes place on the surface of the drum, with the formed image being essentially the same size as the respective LED.

5. The LED print head according to claim 4, wherein said photosensitive drum is a barrel-shaped photosensitive drum.

6. The LED print head according to claim 4, wherein said mechanism includes:

a slider movable stepwise in a direction substantially parallel to the axis of rotation, said slider causing said LED circuit board to deform stepwise relative to the surface of the photosensitive drum; and a holder for engaging said slider to movably hold said slider.

7. The LED print head according to claim 6, wherein said slider has a groove extending at an angle relative to the axis of rotation so that movement of said slider in said direction causes the LED circuit board to further deform as the slider moves toward a middle of the LED chips mounted in line.

8. The LED print head according to claim 7, wherein said groove is provided with a rack so that said slider moves stepwise as the slider moves in said direction.

9. The LED print head according to claim 4, further including:

a mechanism for adjusting a distance between the LED print head and the photosensitive drum.

10. The LED print head according to claim 9, wherein said mechanism for adjusting a distance includes:

a rack movable together with said lens assembly, and having a first inclined surface;

a wedge having a second inclined surface, said wedge being adapted to slide relative to said rack with the second inclined surface in slidable contact with the first inclined surface; and a V-shaped tip provided on said wedge and engaging the rack stepwise to hold said wedge in position when said wedge slides.

* * * * *